US009144252B1

(12) United States Patent
Kostrzewski

(10) Patent No.: US 9,144,252 B1
(45) Date of Patent: Sep. 29, 2015

(54) STABILIZING GARMENT SYSTEM

(71) Applicant: Kris A. Kostrzewski, Sylvania, OH (US)

(72) Inventor: Kris A. Kostrzewski, Sylvania, OH (US)

( * ) Notice: Subject to any disclaimer, the term of this patent is extended or adjusted under 35 U.S.C. 154(b) by 121 days.

(21) Appl. No.: 14/012,026

(22) Filed: Aug. 28, 2013

Related U.S. Application Data

(63) Continuation-in-part of application No. 13/353,017, filed on Jan. 18, 2012, now Pat. No. 8,533,864, which is a continuation-in-part of application No. 12/412,321, filed on Mar. 26, 2009, now abandoned.

(51) Int. Cl.
*A41D 1/06* (2006.01)
*A41D 1/08* (2006.01)

(52) U.S. Cl.
CPC ..... *A41D 1/08* (2013.01)

(58) Field of Classification Search
CPC .... A61F 13/00; A41D 13/00; A41D 13/0005; A41D 13/0002; A41D 13/0015; A41D 2400/38; A41D 1/06
USPC ..... 2/69, 73, 78.3, 79, 227, 228
See application file for complete search history.

(56) References Cited

U.S. PATENT DOCUMENTS

| | | | | |
|---|---|---|---|---|
| 4,065,814 | A | 1/1978 | Fox | |
| 4,698,847 | A | 10/1987 | Yoshihara | |
| 4,731,882 | A | 3/1988 | Ekman | |
| 4,862,523 | A * | 9/1989 | Lipov | 2/409 |
| 4,910,802 | A | 3/1990 | Malloy | |
| 5,109,546 | A * | 5/1992 | Dicker | 2/70 |
| 5,201,074 | A * | 4/1993 | Dicker | 2/70 |
| 5,263,923 | A * | 11/1993 | Fujimoto | 602/62 |
| 5,282,277 | A | 2/1994 | Onozawa | |
| 5,367,708 | A | 11/1994 | Fujimoto | |
| 5,659,895 | A * | 8/1997 | Ford, Jr. | 2/2.11 |
| 5,699,559 | A | 12/1997 | Sano | |
| 5,737,772 | A | 4/1998 | Dicker et al. | |
| 5,737,773 | A | 4/1998 | Dicker et al. | |
| 5,819,322 | A * | 10/1998 | Dicker et al. | 2/456 |
| 5,829,058 | A | 11/1998 | Dicker et al. | |
| 5,839,122 | A * | 11/1998 | Dicker et al. | 2/67 |
| 5,842,959 | A | 12/1998 | Wilkinson | |

(Continued)

FOREIGN PATENT DOCUMENTS

| | | | |
|---|---|---|---|
| EP | 2430931 A1 * 3/2012 | | |
| WO | WO 2010131864 A2 * 11/2010 | | A41D 1/12 |

(Continued)

OTHER PUBLICATIONS

"human muscle system." Encyclopaedia Britannica. Encyclopædia Britannica Online Academic Edition. Encyclopædia Britannica Inc., 2015. Web. Feb. 19, 2015. <http://academic.eb.com/EBchecked/topic/1346474/human-muscle-system>.*

(Continued)

*Primary Examiner* — Amy Vanatta
*Assistant Examiner* — Jillian K Pierorazio

(57) ABSTRACT

The present invention features a stabilizing garment system featuring a shirt component and a pant component and strips of spandex integrated into the shirt component and the pant component. The strips of spandex follow the path of a ligament or a muscle of the wearer. The strips of spandex can help provide compression or added support to the wearer's ligaments and/or muscles.

5 Claims, 4 Drawing Sheets

(56) References Cited

U.S. PATENT DOCUMENTS

| | | | | |
|---|---|---|---|---|
| 5,857,947 | A * | 1/1999 | Dicker et al. | 482/124 |
| 5,867,827 | A | 2/1999 | Wilkinson | |
| 5,875,491 | A * | 3/1999 | Wilkinson | 2/69 |
| 5,937,442 | A | 8/1999 | Yamaguchi et al. | |
| 5,960,474 | A | 10/1999 | Dicker et al. | |
| 5,978,966 | A | 11/1999 | Dicker et al. | |
| 6,047,406 | A | 4/2000 | Dicker et al. | |
| 6,176,816 | B1 | 1/2001 | Dicker et al. | |
| 6,231,488 | B1 * | 5/2001 | Dicker et al. | 482/124 |
| 6,430,752 | B1 * | 8/2002 | Bay | 2/228 |
| 6,446,264 | B2 | 9/2002 | Fairhurst et al. | |
| 7,089,597 | B2 | 8/2006 | Horii et al. | |
| D539,512 | S | 4/2007 | Ota et al. | |
| D620,686 | S * | 8/2010 | Morii et al. | D2/742 |
| 7,945,970 | B2 * | 5/2011 | Belluye et al. | 2/69 |
| 8,286,262 | B2 | 10/2012 | Rance et al. | |
| 8,375,468 | B2 | 2/2013 | Okamoto et al. | |
| 8,910,317 | B2 * | 12/2014 | Decker | 2/227 |
| 2004/0107479 | A1 * | 6/2004 | Dicker et al. | 2/227 |
| 2004/0255358 | A1 * | 12/2004 | Ota et al. | 2/69 |
| 2005/0193461 | A1 * | 9/2005 | Caillibotte et al. | 2/69 |
| 2006/0130215 | A1 * | 6/2006 | Torry | 2/227 |
| 2007/0074328 | A1 | 4/2007 | Melhart et al. | |
| 2007/0214541 | A1 | 9/2007 | Kawasaki et al. | |
| 2009/0025115 | A1 * | 1/2009 | Duffy et al. | 2/69 |
| 2009/0144873 | A1 * | 6/2009 | Jewell et al. | 2/24 |
| 2009/0265828 | A1 | 10/2009 | Semba et al. | |
| 2010/0281593 | A1 * | 11/2010 | Aloy Font | 2/22 |
| 2011/0041226 | A1 * | 2/2011 | Arensdorf | 2/22 |
| 2011/0214216 | A1 * | 9/2011 | Zarabi | 2/69 |
| 2011/0314590 | A1 * | 12/2011 | Perron et al. | 2/227 |
| 2013/0160189 | A1 * | 6/2013 | Yang | 2/227 |
| 2013/0326785 | A1 * | 12/2013 | Cornacchiari et al. | 2/69 |
| 2014/0059741 | A1 * | 3/2014 | Lou et al. | 2/227 |

FOREIGN PATENT DOCUMENTS

| | | | |
|---|---|---|---|
| WO | WO 2012043686 | A1 * | 4/2012 |
| WO | WO 2013179440 | A1 * | 12/2013 |

OTHER PUBLICATIONS

"leg." Encyclopaedia Britannica. Encyclopaedia Britannica Online Academic Edition. Encyclopædia Britannica Inc., 2015. Web. Feb. 19, 2015. <http://academic.eb.com/EBchecked/topic/334805/leg>.*

"knee." Encyclopaedia Britannica. Encyclopaedia Britannica Online Academic Edition. Encyclopædia Britannica Inc., 2015. Web. Feb. 19, 2015. <http://academic.eb.com/EBchecked/topic/320231/knee>.*

"pelvic girdle." Encyclopaedia Britannica. Encyclopaedia Britannica Online Academic Edition. Encyclopædia Britannica Inc., 2015. Web. Feb. 19, 2015. <http://academic.eb.com/EBchecked/topic/449463/pelvic-girdle>.*

Taylor, Tim. Muscular system. Inner Body, Feb. 18, 2015. http://www.innerbody.com/image/musfov.html.*

* cited by examiner

STABILIZING GARMENT SYSTEM

CROSS REFERENCE

This application is a continuation-in-part of U.S. patent application Ser. No. 13/353,017 filed on Jan. 18, 2012, which is a continuation-in-part of U.S. patent application Ser. No. 12/412,321 filed Mar. 26, 2009, the disclosure of which is incorporated herein by reference in its entirety.

FIELD OF THE INVENTION

The present invention is directed to a garment to be worn during exercise, more particularly to a garment worn during exercise that may help prevent strains and/or sprains.

BACKGROUND OF THE INVENTION

The present invention features a stabilizing garment system for wear during exercise. The stabilizing garment system is an article of clothing comprising one or more areas of spandex that follow the path of a ligament and/or a muscle of a wearer. The areas of spandex are for providing compression and/or added support to the wearer's ligaments and/or muscles. In some embodiments, the stabilizing garment system may help reduce pain in joints and/or pain in the back. The system may feature a shirt (e.g. short sleeved, long sleeved), a pair of pants, a pair of shorts, or a combination thereof.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-6 present invention features a stabilizing garment system 100 for wearing during exercise. Without wishing to limit the present invention to any theory or mechanism, it is believed that the stabilizing garment system 100 of the present invention may help prevent injuries.

The stabilizing garment system 100 comprises a shirt component 110 (not shown) (e.g., long sleeved, short sleeved, tank top style, etc.) and a pant component 210 (e.g., shorts, pants, mid-calf length pants, etc.). The shape of the shirt component 110 (not shown) resembles standard shirts, which are well known to one of ordinary skill in the art. The shape of the pant component 210 resembles standard pants (e.g., long pants, shorts, cropped pants, etc.), which are well known to one of ordinary skin in the art.

Figure 6:
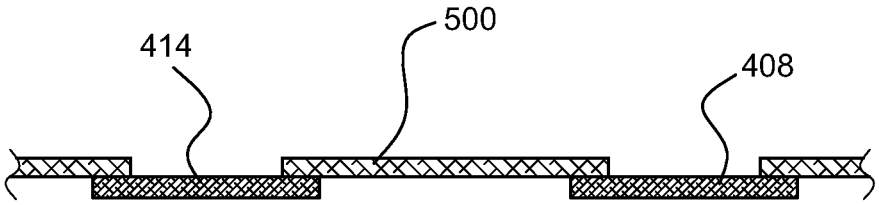
FIG. 6 is a cross-sectional view of the system of the present invention.

Integrated into both the shirt component 110 and the pant component 210 are strips of spandex (e.g., elastane). As shown in FIG. 6, the strips of spandex are sandwiched between clothing material. The strips of spandex follow the path of a ligament and/or a muscle of the wearer (e.g., see EXAMPLE below). The strips of spandex can help provide compression and/or added support to the wearer's ligaments and/or muscles. In some embodiments, the stabilizing garment system 100 reduces pain in joints and/or pain in the back. In some embodiments, the stabilizing garment system 100 increases the wearer's energy.

The shirt component 110 comprises a front torso section 130*a* with a first side edge 131*a* on a first front half 601 and a second side edge 132*a* on a second front half 602 and a back torso section 130*b* with a first side edge 131*b* on a first back half 603 and a second side edge 132*b* on a second back half 604. The back torso section 130*b* is opposite the front torso section 130*a* (the torso sections 130*a*/130*b* are separated by a gap adapted to accept a wearer's torso) and the bottom portions of the first side edges 131*a*/131*b* of the torso sections 130*a*/130*b* are connected and the bottom portions of the second side edges 132*a*/132*b* of the torso sections 130*a*/130*b* are connected. The shirt component 110 further comprises a neck hole 120 at the intersection of the tops of the torso sections 130*a*/130*b*. In some embodiments, a first sleeve 140*a* extends from the top portions of the first side edges 131*a*/131*b* of the torso sections 130*a*/130*b*, and a second sleeve 140*b* extends from the top portions of the second side edges 132*a*/132*b* of the torso sections 130*a*/130*b*. The sleeves 140*a*/140*b* may be short or long (or the sleeves 140*a*/140*b* may be optional if the shirt component 110 is a tank top).

A first shirt strip 301 is disposed around the neck hole 120 (spaced a distance from the neck hole 120). A second shirt strip 302 is disposed along the bottom edge of the front torso section 130*a* and back torso section 130*b*. A third shirt strip 303 is disposed in the front torso section 130*a* and extends from the first shirt strip 301 to the second shirt strip 302 along a front mid-line 501. A fourth shirt strip 304 is disposed in the back torso section 130*b* and extends from the first shirt strip 301 to the second shirt strip 302 along a back mid-line 502.

A fifth shirt strip 305 extends from a first front intersection 551 of the first shirt strip 301 and the third shirt strip 303 below the first sleeve 140*a* and further to a first back intersection 555 of the first shirt strip 301 and the fourth shirt strip 304. A sixth shirt strip 306 extends from a second front intersection 552 of the first shirt strip 301 and the third shirt strip 303 below the second sleeve 140*b* and further to a second back intersection 556 of the first shirt strip 301 and the fourth shirt strip 304.

A seventh shirt strip 307 extends from a third front intersection 553 of the second shirt strip 302 and the third shirt strip 303 upward to the first side edge 131*a* of the front torso section 130*a* at an elbow line 505 of the shirt component 110. The third front intersection 553 is at the front mid-line 501 and a hip line 507 of the shirt component 110. The elbow line 505 is the straight line where a wearer's elbows are from one elbow to the other. The hip line 507 is the straight line where the wearer's hips are from one hip end to the other hip end. The elbow line 505 is parallel to the hip line 507. An eighth shirt strip 308 extends from a fourth front intersection 554 of the second shirt strip 302 and the third shirt strip 303 to the second side edge 132*a* of the front torso section 130*a* at the elbow line 505. The fourth front intersection 554 is at the front mid-line 501 and the hip line 507 of the shirt component 110.

A ninth shirt strip 309 extends from the first back intersection 555 of the first shirt strip 301 and the fourth shirt strip 304 on the first back half 603 downward to the first side edge 131*b* at a third back intersection 557 of the back torso section 130*b* (where the ninth shirt strip 309 joints the fourth shirt strip 304). A tenth shirt strip 310 extends from the second back intersection 556 of the first shirt strip 301 and the fourth shirt strip 304 on the second back half 604 downward to the second side edge 132*b* at a fourth back intersection 558 of the back torso section 130*b*. The first back intersection 555 and the second back intersection 556 are at the back mid-line 502 and a shoulder line 503. The third back intersection 557 and the fourth back intersection 588 are on the side edges 131*b*/132*b* of the back torso 130*b* at a sternum line 508 of the shirt component 110. The sternum line 508 is the straight line where the sternum of a wearer of the shirt component 110 is. The sternum line 508 is parallel to the hip line 507. The shoulder line 503 is a straight line from a first shoulder 145*a* to a second shoulder 145*b* of the wearer of the shirt component 110, wherein the shoulder line 503 is parallel to the hip line 507.

An eleventh shirt strip 311 extends from the third back intersection 557 downward to a first point 304*a* on the fourth shirt strip 304. The first point 304*a* is around the elbow line 505 of the shirt component 110. A twelfth shirt strip 312 extends from the fourth back intersection 558 downward to the first shirt point 304*a*.

A thirteenth shirt strip 313 extends from the first shirt point 304*a* downward to the first side edge 131*b* of the back torso section 130*b* just above the hip line 507 of the shirt component. A fourteenth shirt strip 314 extends from the first shirt point 304*a* downward to the second side edge 132*b* of the back torso section 130*b* just above the hip line 507 of the shirt component.

In some embodiments, the system further comprises a first sleeve 140*a* extending from top portions of the first side edges 131*a*/131*b* of the torso sections 130*a*/130*b* at the shoulder line 503, which extend down to a first wrist end 146*a* below the hip line 507. A second sleeve 140*b* extends from top portions of the second side edges 132*a*/132*b* of the torso sections 130*a*/130*b* at the shoulder line 503, which extend down to a second wrist end 146*b* below the hip line 507.

In some embodiments, the system 100 further comprises a fifteenth shirt strip 315 which extends from the first shirt strip 301 on the first front half 601 between the front mid-line 501 and the first side edge 131*a* of the front torso section 130*a* downward to an armpit line 504, then extends upward to the first shirt strip 301 on the first back half 603 between the back mid-line 502 and the first side edge 131*b* of the back torso section 130*b*. In some embodiments, the system 100 further comprises a sixteenth shirt strip 316 which extends from the first shirt strip 301 on the second front half 602 between the front mid-line 501 and the second side edge 132*a* of the front torso section 130*a* downward to the armpit line 504, then extends upward to the first shirt strip 301 on the second back half 604 between the back mid-line 502 and the second side edge 132*b* of the back torso section 130*b*. The armpit line 504 is the straight line from the wearer's armpit area from one underarm to the other. The armpit line 504 is parallel to the hip line 507.

In some embodiments, the system 100 further comprises a seventeenth shirt strip 317 which starts at the elbow line 505 of the first sleeve 140*a* in the back, and wraps upward around the upper arm to the front of the first sleeve 140*a* between the armpit line 504 and the elbow line 505, then downward back to the back of the elbow line 505 crossing the starting point and continuing downward and wraps around the forearm to the front of the first sleeve 140*a* between the elbow line 505 and the first wrist end 146*a*, and then finally wraps back upward to the starting point at the elbow line 505, where in the seventeenth shirt strip 317 forms a figure eight shape. In some embodiments, the system 100 further comprises an eighteenth shirt strip 318 which starts at the elbow line 505 of the second sleeve 140*b* in the back and wraps upward to the front of the second sleeve 140*b* around the upper arm between the armpit line 504 and the elbow line 505, and then wraps downward around the arm back to the back of the elbow line 505 crossing the starting point, and then continuing downward and wraps around the front of the second sleeve 140*b* around the forearm between the elbow line 505 and the second wrist end 146*b*, and finally wraps back upward to the starting point at the elbow line 505, where in the eighteenth shirt strip 318 forms a figure eight shape.

In some embodiments, a strip stabilizes the conoid ligament and trapezoid ligaments and is positioned at the coracoid process of the scapula and coracoid tuberosity under the clavicle. The direction of the fibers (e.g., vector of action) is upward. The strip stabilizes the scapula against the clavicle and controls motion of the brachial girdle. In some embodiments, a strip stabilizes the coracoacramial ligament and is positioned at the coracoid process of the scapula and acromion of the scapula. The direction of the fibers (e.g., vector of action) is upward, e.g., about 45° laterally. The strip stabilizes the clavicle.

In some embodiments, a strip stabilizes the bicipital aponeurosis and is positioned along the humerus. The direction of the fibers (e.g., vector of action) is upward. The strip reinforces bicipital attachments. In some embodiments, a strip stabilizes the supraspinal ligament and is positioned along spinal processes of the cervical spine up to the sacral spine. The direction of the fibers (e.g., vector of action) is upward. The strip stabilizes the spine.

In some embodiments, a strip stabilizes the glenohumeral ligament and is positioned at the glenoid cavity of the scapula and the head of the humerus. The direction of the fibers (e.g., vector of action) is transversal. The strip protects the stability of the head of the humerus. In some embodiments, a strip stabilizes the pectoral fascia and is positioned at the front of the sternum and clavicle. The direction of the fibers (e.g., vector of action) is upward, e.g., about 45° laterally. The strip stabilizes the chest and clavicle.

In some embodiments, a strip stabilizes the lines alba and is positioned at the abdominal muscles. The direction of the fibers (e.g., vector of action) is upward. The strip stabilizes the lower chest and abdomen in the midline. In some embodiments, a strip stabilizes the ligaments of the elbow and is positioned at the radius, ulna, and humerus. The direction of the fibers (e.g., vector of action) is transversal. The strip stabilizes the elbow to valgus and varus stress.

In some embodiments, a strip stabilizes the nuchal fascia and is positioned at the medially spinous processes of the cervical spine and laterally upper ribs. The direction of the fibers (e.g., vector of action) is transversal. The strip encloses posterior muscles of the neck and stabilizes the neck posteriorly. In some embodiments, a strip stabilizes the subscapularis ligaments and is positioned at the scapula and humerus. The direction of the fibers (e.g., vector of action) is transversal. The strip stabilizes (posteriorly) the shoulder.

In some embodiments, a strip stabilizes the longitudinal ligaments and lumbar interspinous ligament and is positioned to connect the bodies of vertebrae by attachment to the intervertebral discs and laminae of the vertebrae. The direction of the fibers (e.g., vector of action) is upward and downward. The strip helps to preserve stability of the spinal column and helps to hold the body erect. In some embodiments, a strip stabilizes the thoracolumbar fascia and is positioned to cover the deep muscles of the back. The direction of the fibers (e.g., vector of action) is upward and downward. The strip stabilizes the vertebral column.

As shown in FIG. 1-6, the pant component 210 comprises a front pelvis section 230*a* with a first side edge 231*a* and a second side edge 232*a* and a back pelvis section 230*b* with a first side edge 231*b* and a second side edge 232*b*. The back pelvis section 230*b* is opposite the front pelvis section 230*a* (the pelvis sections 230*a*/230*b* are separated by a gap adapted to accept a wearer's pelvis and groin). The first side edges 231*a*/231*b* of the pelvis sections 230*a*/230*b* are connected and the second side edges 232*a*/232*b* of the pelvis sections 230*a*/230*b* are connected. The pelvis sections 230*a*/230*b* are connected at a groin seam 218. The pant component 210 further comprises a waist hole 220 formed by the top edges of the pelvis sections 230*a*/230*b* at a waist line 510. The waist line 510 is the straight line where the waist of a wearer of the pant component 210 is located. A first leg 240*a* extends downwardly from the first site edges 231*a*/231*b* of the pelvis sections 230*a*/230*b* to an ankle line 513, and a second leg 240*b* extends downwardly from the second side edges 232*a*/232*b* of the pelvis sections 230*a*/230*b* to the ankle line 513. The ankle line 513 is the straight line that extends from the first bottom end 244*a* to the second bottom end 244*b* wherein the ankle line is parallel to the waist line. The legs 240*a*/240*b* may be short or long. The legs 240*a*/240*b* each have an outer seam that aligns with the respective first side edges 231*a*/231*b* or second side edges 232*a*/232*b* of the pelvis sections 230*a*/230*b* and an inner seam that extends from the groin seam 218 to the respective bottom ends 244*a*/244*b* of the legs 240*a*/240*b*.

Figure 1:
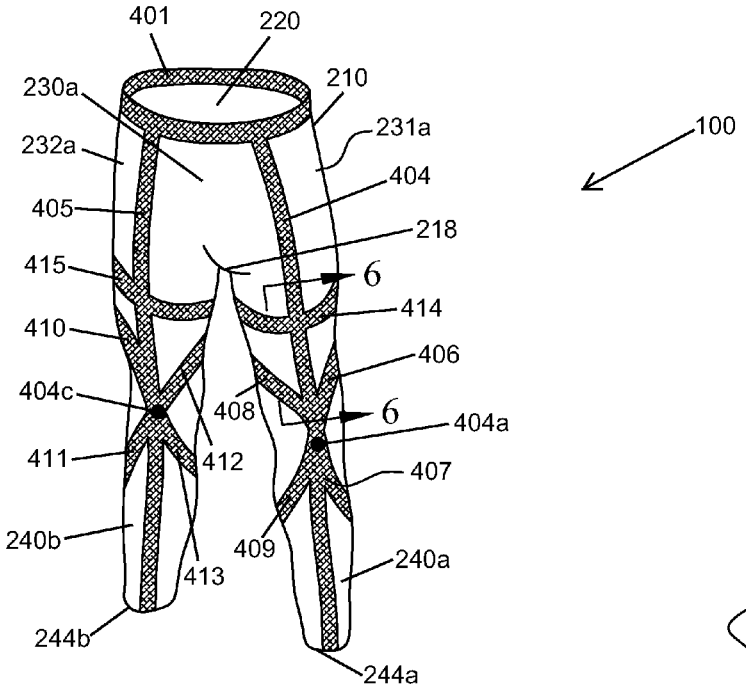
FIG. 1 is a front perspective view of the system of the present invention (e.g., pants).
Figure 2:
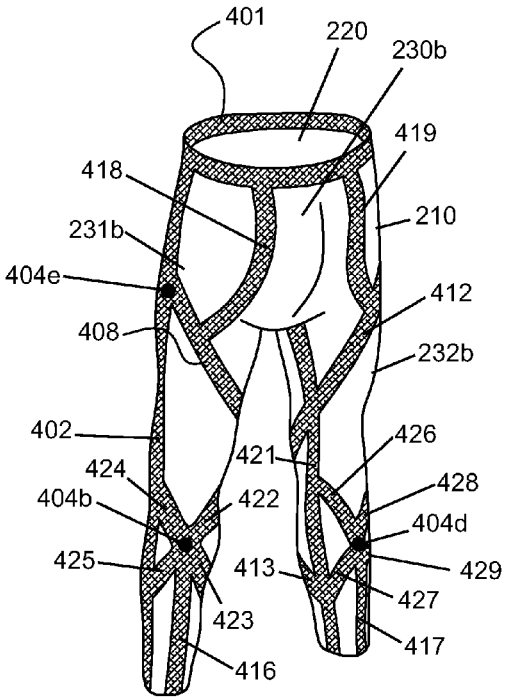
FIG. 2 is a back perspective view of the system of the present invention (e.g., pants).
Figure 3:
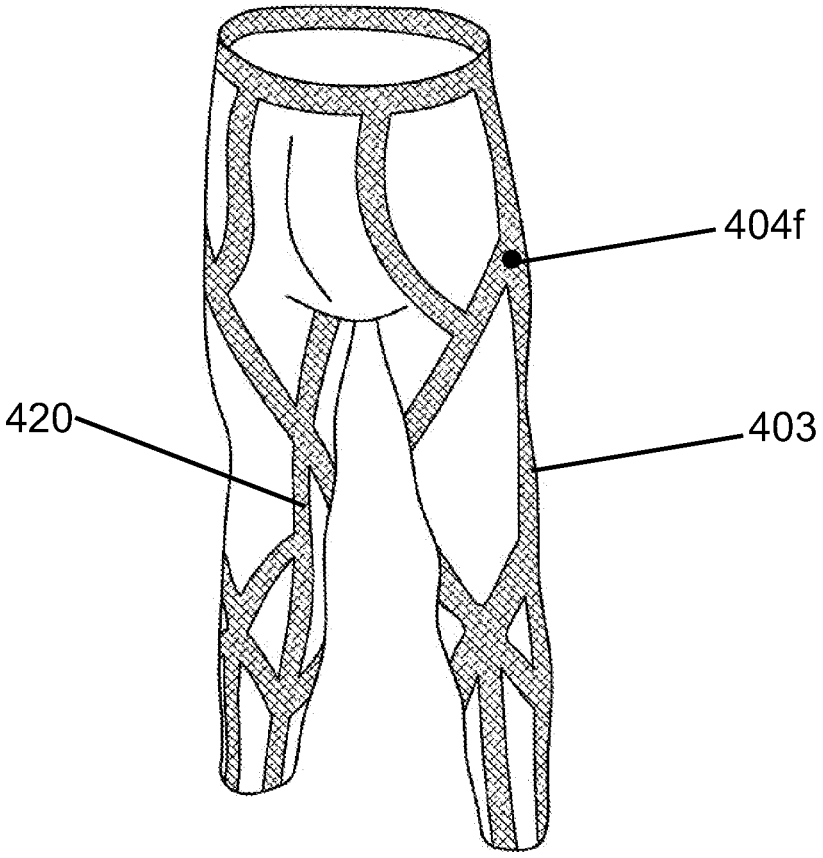
FIG. 3 is another back perspective view of the pant component of the present invention.
Figure 4:
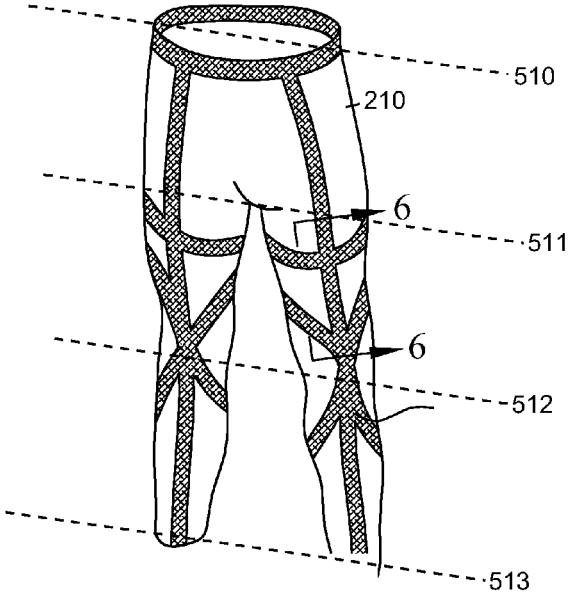
FIG. 4 is another front perspective view of the pant component of the present invention.
Figure 5:
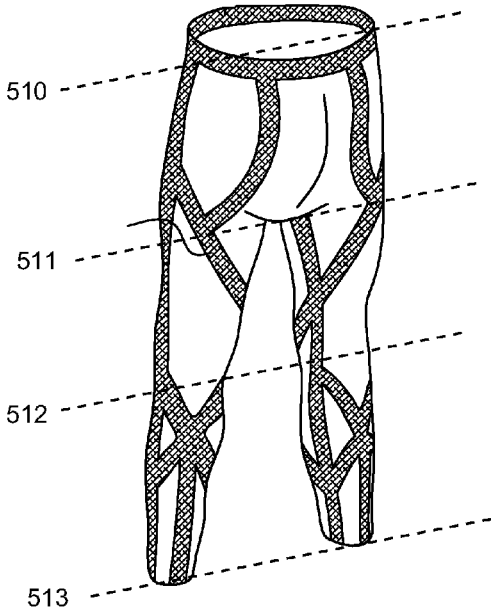
FIG. 5 is another back perspective view of the pant component of the present invention.

A first pant strip 401 is disposed around the waist hole 220 as shown in FIG. 1 and FIG. 2.

In some embodiments, a second pant strip 402 has a starting point at the first pant strip 401 and extends from the first pant strip 401 down along the first side edges 231*a*/231*b* of the pelvis sections 230*a*/230*b* (or slightly in front of or in back of the first side edges 231*a*/231*b*) generally parallel to the first side edges 231*a*/231*b* to the bottom end 244*a* of the first leg 240*a*. In some embodiments, a third pant strip 403 has a starting point at the first pant strip 401 and extends from the first pant strip 401 down along the second side edges 232*a*/232*b* of the pelvis sections 230*a*/230*b* or slightly in front of or in back of the second side edges 232*a*/232*b* generally parallel to the second side edges 232*a*/232*b* to the bottom end 244*b* of the second leg 240*b*. In some embodiments, a first inseam strip 420 has a starting point at the groin seam 218 at a groin line 511 and extends from the groin seam 218 to the bottom end 244*a* of the first leg 240*a* along the inner seam of the first leg 240*a*. In some embodiments, a second inseam strip 421 has a starting point at the groin seam 218 at a groin line 511 and extends from the groin seam 218 at a groin line 511 to the bottom end 244*b* of the second leg 240*b* along the inner seam of the second leg 240*b*. The groin line is the straight line where the groin of a wearer of the pant component 210 is located, wherein the groin line 511 is parallel to the waist line 510.

A fourth pant strip 404 has a starting point at the first pant strip 401 and extends from the first pant strip 401 down to the bottom end 244*a* of the first leg 240*a* and is positioned in between the first side edges 231*a*/231*b* of the pelvis sections and the groin seam 218/inner seam (e.g., the fourth pant strip 404 is positioned to run over the wearer's knee). A fifth pant strip 405 has a starting point at the first pant strip 401 and extends from the first pant strip 401 down to the bottom end 244*b* of the second leg 240*b* and is positioned in between the second side edges 232*a*/232*b* of the pelvis sections and the groin seam 218/inner seam (e.g., the fifth pant strip 405 is positioned to run over the wearer's knee).

A sixth pant strip 406 has a starting point at a first pant point 404*a* on the fourth pant strip 404 at a knee line 512 and extends from the first pant point 404*a* on the fourth pant strip 404 upwardly and to the second pant strip 402 or to the outer seam of the first leg 240*a*. A seventh pant strip 407 has a starting point at the first pant point 404*a* on the fourth pant strip 404 at a knee line 512 and extends from the first pant point 404*a* on the fourth pant strip 404 downwardly and to the second pant strip 402 or to the outer seam of the first leg 240*a*. The knee line 512 is the straight line from one knee to the other knee of the wearer of the pant component 210, wherein the knee line 512 is parallel to the waist line 513 and is positioned about midway between the groin line 511 and the ankle line 513. An eighth pant strip 408 has a starting point at the first pant point 404*a* on the fourth pant strip 404 and extends from the first pant point 404*a* on the fourth pant strip 404 upwardly and past the inner seam of the first leg 240*a* then further upwardly to a fifth pant point 404*e* on the second pant strip 402 (the fifth pant point 404*e* corresponding to a point on the second pant strip 402 in line with the groin seam 218 (a distance downwardly from the first pant strip 401, e.g., the hip area). A ninth pant strip 409 has a starting point at the first pant point 404*a* on the fourth pant strip 404 and extends from the first pant point 404*a* on the fourth pant strip 404 downwardly and to the first inseam strip 420 or to the inner seam of the first leg 240*a*. The sixth pant strip 406, seventh pant strip 407, a portion of the eighth pant strip 408, and ninth pant strip 409 together encompass the knee area of the wearer.

A fourteenth pant strip 422 has a starting point at a second pant point 404*b* (the second pant point 404*b* being opposite the first pant point 404*a*) and extends from the second pant point 404*b* upwardly and to the first inseam strip 420 or to the inner seam of the first leg 240*a*. A fifteenth pant strip 423 has a starting point at the second pant point 404*b* and extends from the second pant point 404*b* downwardly and to the first inseam strip 420 or to the inner seam of the first leg 240*a*. A sixteenth pant strip 424 has a starting point at the second pant point 404*b* and extends from the second pant point 404*b* upwardly and to the second pant strip 402 or to the outer seam of the first leg 240*a*. A seventeenth pant strip 425 has a starting point at the second pant point 404*b* and extends from the second pant point 404*b* downwardly and to the second pant strip 402 or to the outer seam of the first leg 240*a*.

A tenth pant strip 410 has a starting point at a third pant point 404*c* on the fifth pant strip 405 (the third pant point 404*c* corresponding to where the wearer's knees would be positioned, e.g., on the fifth pant strip 405 a distance downwardly from the groin seam 218) and extends from the third pant point 404*c* on the fifth pant strip 405 upwardly and to third pant strip 403 or to the outer seam of the second leg 240*b*. An eleventh pant strip 411 has a starting point at the third pant point 404*c* on the fifth pant strip 405 and extends from the third pant point 404*c* on the fifth pant strip 405 downwardly and to the third pant strip 403 or to the outer seam of the second leg 240*b*. A twelfth pant strip 412 has a starting point at the third pant point 404*c* on the fifth pant strip 405 and extends from the third pant point 404*c* on the fifth pant strip 405 upwardly and past the inner seam of the second leg 240*b* then further upwardly to a sixth pant point (404*f*) on the third pant strip 403 (the sixth pant point 404*f* corresponding to a point on the third pant strip 403 in line with the groin seam 218, a distance downwardly from the first pant strip 401, e.g., the hip area). A thirteenth pant strip 413 has a starting point at the third pant point 404*c* on the fifth pant strip 405 and extends from the third pant point 404*c* on the fifth pant strip 405 downwardly and to the second inseam strip 421 or to the inner seam of the second leg 240*b*. The tenth pant strip 410, the eleventh pant strip 411, a portion of the twelfth pant strip 412, and the thirteenth pant strip 413 together encompass the knee area of the wearer.

A eighteenth pant strip 426 has a starting point at a fourth pant point 404*d* and extends from a fourth pant point 404*d* upwardly and to the second inseam strip 421 or to the inner seam of the second leg 240*b*. A nineteenth pant strip 427 has a starting point at the fourth pant point 404*d* and extends from the fourth pant point 404*d* downwardly and to the second inseam strip 421 or to the inner seam of the second inseam strip 421. A twentieth pant strip 428 has a starting point at the fourth pant point 404*d* and extends from the fourth pant point 404*d* upwardly and to the third pant strip 403 or to the outer seam of the second leg 240*b*. A twenty-first pant strip 429 has a starting point at the fourth pant point 404*d* and extends from the fourth pant point 404*d* downwardly and to the third pant strip 403 or to the outer seam of the second leg 240*b*.

In some embodiments, a twenty-second pant strip 414 wraps around the first leg 240*a* or a portion of the first leg 240*a* (e.g., the front portion, e.g., from the second pant strip 402 to the first inseam strip 420) and is positioned at or near the groin seam 218. In some embodiments, a twenty-third pant strip 415 wraps around the second leg 240*b* or a portion of the second leg 240*b* (e.g., the front portion, e.g., from the third pant strip 403 to the second inseam strip 421) and is positioned at or near the groin seam 218. In some embodiments, a twenty-fourth pant strip 416 has a starting point at the second pant point 404*b* and extends downwardly from the second pant point 404*b* to the bottom end 244*a* of the first leg 240*a*. In some embodiments, a twenty-fifth pant strip 417 has a starting point at the fourth pant point 404*d* and extends downwardly from the fourth pant point 404*d* to the bottom end 244*b* of the second leg 240*b*.

In some embodiments, an twenty-sixth pant strip 418 has a starting point at the first pant strip (401) and extends from the first pant strip 401 (e.g., the waist area) downwardly on the back pelvis section 230*b* (e.g., on the gluteus area) and to the eighth pant strip 408 (see FIG. 1). In some embodiments, a twenty-seventh pant strip 419 has a starting point at the first pant strip (401) and extends from the first pant strip 401 (e.g., the waist area) downwardly on the back pelvis section 230*b* (e.g., on the gluteus area) and to the twelfth pant strip 412 (see FIG. 1).

In some embodiments, a strip stabilizes the Inguinal ligaments and is positioned at the anterior superior iliac spina and pubic tubercle of the pubic bone. The direction of the fibers (e.g., vector of action) is downward, e.g., 45° medially. The strip helps to protect the groin and the front of the hip. In some embodiments, a strip stabilizes the Iliac fascia and is positioned at the Iliac crest and lesser pelvis. The direction of the fibers (e.g., vector of action) is laterally and medially. The strip helps to stabilize the pelvic area and hip.

In some embodiments, a strip stabilizes the Iliolumbar ligament and is positioned to connect the transverse process of the fifth lumbar vertebrae and the iliac crest. The direction of the fibers (e.g., vector of action) is downward. The strip helps contribute with the interspinous and supraspinous ligaments to stabilize the lower lumbar spine. In some embodiments, a strip stabilizes the Lumbar fascia and is positioned to connect the gluteus maximus and latissimus dorsi muscles. The direction of the fibers (e.g., vector of action) is upward. The strip stabilizes the lumbar spine.

In some embodiments, a strip stabilizes the Femoral fascia and is positioned to attach to the section of the inguinal ligament and condyle of the tibia. The direction of the fibers (e.g., vector of action) is downward. The strip supports stabilization of the hip and knee joints. In some embodiments, a strip stabilizes the Cruciate ligaments of the knee and is positioned to connect the head of the tibia and distal femur. The direction of the fibers (e.g., vector of action) is oblique down and upward. The strip helps to keep the tibia from slipping forward or backward.

In some embodiments, a strip stabilizes the Knee joint capsula and is positioned at the femoral condyles and fascia lata. The direction of the fibers (e.g., vector of action) is transversal. The strip provides passive stability of knee movement and helps to seals the joint space. In some embodiments, a strip stabilizes the Patellar ligament and is positioned to connect the patella and tibia. The direction of the fibers (e.g., vector of action) is downward. The strip helps to provide structure to the extensor apparatus of the knee.

In some embodiments, a strip stabilizes the Retinaculum patelle and is positioned at the margins of the patella and collateral ligament along with tibial condyles. The direction of the fibers (e.g., vector of action) is transversal. The strip helps to stabilize the patella and knee joint. In some embodiments, a strip stabilizes the Tibial fascia and is positioned at the tibial crest. The direction of the fibers (e.g., vector of action) is transversal and downward. The strip helps to protect the anterior tibial compartments.

In some embodiments, a strip stabilizes the Fascia lata and iliotibial track as reinforcement of fascia lata and is positioned at the sacrum, coccyx, iliac crest and inguinal ligament, the pubis and ischium, and at the condyles of femur, tibia and head of fibula. The direction of the fibers (e.g., vector of action) is downward. The strip envelopes the entire thigh and hip region and connects to the stabilizing structures and muscles of pelvis and lower extremity together In some embodiments, a strip stabilizes the Sacroilic ligaments and is positioned at the sacrum and ilium. The direction of the fibers (e.g., vector of action) is transversal. The strip helps to hold together and help stabilize the back of the pelvis.

In some embodiments, a strip stabilizes the Capsule of the hip joint and is positioned from the margin of the hip acetabulum up to the transverse ligament of the hip. The direction of the fibers (e.g., vector of action) is transversal. The strip surrounds the neck of the femur and helps to stabilize the hip joint. In some embodiments, a strip stabilizes the Calf fascia and surrounds the calf muscles. The direction of the fibers (e.g., vector of action) is transversal and downward. The strip helps to stabilize and hold together the calf and knee. In some embodiments, a strip stabilizes the Collateral ligaments of the knee and is positioned to connect the femur and tibia laterally and medially. The direction of the fibers (e.g., vector of action) is downward. The strip helps to resist forces that push the knee medially and laterally and stabilize knee joint.

The strips are constructed from a material comprising spandex/elastane.

As shown in FIG. 6, the strips of spandex are sandwiched between strips of clothing material 500 (e.g., any appropriate clothing material or mixture including but not limited to cotton, polyester, linen, etc.).

The stabilizing garment system 100 of the present invention may be constructed from a variety of materials. In some embodiments, the stabilizing garment is constructed from a material comprising cotton, a spandex, the like, or a combination thereof.

The stabilizing garment system 100 of the present invention may be constructed in a variety of sizes, colors, and/or designs. In some embodiments, the stabilizing garment system 100 is produced in a size for men, women, and/or children.

a) The shirt component 110 and the pant component 210 of the present invention are snugly or tightly fitted to all parts of a wearer's body and follow the wearer's body's contours. For example the armpit portion of the shirt component 110 wraps the armpit of the wearer. Another example is that at the groin region, the groin region snugly or tightly fits over the wearer's groin;

b) all reference lines herein (e.g., waist line 510, hip line 507, elbow line 505, etc.) are defined as the shirt component 110 or pant component 210 is positioned though they are worn by a person with arms down by his side standing straight up and legs together (e.g., U.S. Soldier standing "attention");

c) with respect to the sleeve 140*a*/140*b*, the sleeve 140*a*/140*b* of the present shirt component 110 snugly fits over the wearer's arm from the shoulder 145*a*/145*b* to the wearer's wrist end 146*a*/146*b*, wherein the wrist end 146*a*/146*b* overlays the wearer's wrist; and d) with respect to the elbow line 505, the elbow line 505 is halfway between the shoulder line 503 and the wrist end 146*a*/146*b*.

EXAMPLES

The following example describes groups that are examples of the focus of the system of the present invention. Each group has a list wherein the number refers as follows: the anatomic name of the stabilizing structure (1), the attachment points (2), the direction of fibers/vector of action (3), and the biomechanical action (4). The present invention is not limited to the examples described herein.

Group 1

1. ANATOMIC NAME OF STABILIZING STRUCTURE: Conoid ligament and trapezoid ligaments.
2. ATTACHMENT POINTS: Coracoid process of the scapula and coracoid tuberosity under the clavicle.
3. DIRECTION OF FIBERS, VECTOR OF ACTION: upward
4. BIOMECHANICAL ACTION: stabilizing scapula against clavicle and controlling a motion of the brachial girdle.

Group 2

1. Coracoacramial ligament.
2. coracoid process of the scapula and acromion of the scapula.
3. upward and 45° laterally.
4. stabilizing clavicle.

Group 3

1. Bicipital aponeurosis.
2. along humerus.
3. upward
4. reinforces bicipital attachments.

Group 4

1. Supraspinal ligament.
2. along spinal processes of cervical up to sacral spine.
3. upward
4. stabilizing spine.

Group 5

1. glenohumeral ligament
2. glenoid cavity of the scapula and the head of the humerus.
3. transversal.
4. protects stability of the head of the humerus.

Group 6

1. pectoral fascia
2. front of sternum and clavicle.
3. upward and 45° laterally.
4. stabilizing chest and clavicle.

Group 7

1. Linea alba.
2. attached to abdominal muscles.
3. upward
4. stabilizing lower chest and abdomen in the midline.

Group 8

1. Ligaments of the elbow
2. Radius, ulna and humerus.
3. transversal.
4. major stabilizers of the elbow to valgus and varus stress.

Group 9

1. Inguinal ligaments.
2. Anterior superior iliac spina and pubic tubercle of the pubic bone.
3. downward and 45° medially.
4. protects groin and front of the hip.

Group 10

1. Iliac fascia.
2. Iliac crest and lesser pelvis.
3. laterally and medially
4. stabilizing pelvic area and hip.

Group 11

1. Nuchal fascia.
2. medially spinous processes of the cervical spine and laterally upper ribs.
3. transversal
4. encloses posterior muscles of the neck and stabilizes neck posteriorly.

Group 12

1. Subscapularis ligaments.
2. Scapula and humerus
3. transversal
4. posterior stabilization of the shoulder.

Group 13

1. Longitudinal ligaments and lumbar interspinous ligament.
2. they connect the bodies of vertebrae by attachment to the intervertebral discs and laminae of the vertebrae.
3. up and downward 4. to preserve stability of the spinal column and to help hold the body erect.

Group 14

1. Thoracolumbar fascia
2. covers the deep muscles of the back.
3. up and downwards
4. to stabilize the vertebral column.

Group 15

1. Iliolumbar ligament
2. connects transverse process of the fifth lumbar vertebrae and iliac crest
3. downward
4. contributes with the interspinous and supraspinous ligaments to stabilize the lower lumbar spine.

Group 16

1. Lumbar fascia
2. connects the gluteus maximus and latissimus dorsi muscles.
3. upward
4. stabilizes lumbar spine.

Group 17

1. Femoral fascia
2. attached to section of inguinal ligament and condyle of the tibia.
3. downward
4. supports stabilization of the hip and knee joints.

Group 18

1. Cruciate ligaments of the knee
2. connecting head of the tibia and distal femur
3. oblique down and upward
4.keeps the tibia from slipping forward or backward.

Group 19

1. Knee joint capsula.
2. femoral condyles and fascia lata.
3. transversal
4. provides passive stability by limiting knee movement and seals the joint space.

Group 20

1. Patellar ligament
2. connects patella and tibia
3. downward
4. main structure of the extensor apparatus of the knee.

Group 21

1. Retinaculum patella
2. margins of patella and collateral ligament along with tibial condyles.
3. transversal
4. stabilizes patella and knee joint.

Group 22

1. Tibial fascia
2. tibial crest
3. transversal and downward
4. protects anterior tibial compartments.

Group 23

1. Fascia lata and iliotibial track as reinforcement of fascia lata.
2. Above and behind: attached to sacrum, coccyx, iliac crest and inguinal ligament, also to pubis and ischium
Below end: condyles of femur, tibia and head of fibula.
3. downward
4. envelopes entire thigh and hip region and connects stabilizing structures and muscles of pelvis and lower extremity together.

Group 24

1. Sacroilic ligaments
2. connect sacrum and ilium
3. transversal
4. hold together and help stabilize the back of the pelvis.

Group 25

1. Capsule of the hip joint
2. from the margin of the hip acetabulum up to transverse ligament of the hip
3. transversal
4. surrounds the neck of the femur and stabilizes hip joint.

Group 26

1. Calf fascia
2. surrounds calf muscles
3. downward and transversal
4. Stabilizes and holds together calf and knee.

Group 27

1. Collateral ligaments of the knee
2. connect femur and tibia laterally and medially,
3. downward
4. resist forces that push the knee medially and laterally and stabilize knee joint.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A stabilizing garment system (100) for providing support to a muscle or a ligament, said stabilizing garment system (100) comprising a pant component (210) comprising:

a) a front pelvis section (230*a*) with a first side edge (231*a*) and a second side edge (232*a*) and a back pelvis section (230*b*) with a first side edge (231*b*) and a second side edge (232*b*), the first side edges (231*a*/231*b*) of the pelvis sections (230*a*/230*b*) are connected and the second side edges (232*a*/232*b*) of the pelvis sections (230*a*/230*b*) are connected, and the pelvis sections (230*a*/230*b*) are further connected at a groin seam (218);

b) a waist hole (220) formed by top edges of the pelvis sections (230*a*/230*b*) at a waist line (510) of the pant component (210), the waist line (510) is a straight line where a waist of a wearer of the pant component (210) is located;

c) a first leg (240*a*) extending downwardly from the first side edges (231*a*/231*b*) of the pelvis sections (230*a*/230*b*) to an ankle line (513) of the pant component (210), and a second leg (240*b*) extending downwardly from the second side edges (232*a*/232*b*) of the pelvis sections (230*a*/230*b*) to the ankle line (513) of the pant component (210), the legs (240*a*/240*b*) each have bottom ends (244*a*/244*b*), the legs (240*a*/240*b*) each have an outer seam that aligns with the respective first side edges (231*a*/231*b*) or second side edges (232*a*/232*b*) of the pelvis sections (230*a*/230*b*) and an inner seam that extends from the groin seam (218) to the respective bottom ends (244*a*/244*b*) of the legs (240*a*/240*b*), the ankle line (513) is a straight line that extends from the first bottom end (244*a*) to the second bottom end (244*b*) wherein the ankle line (513) is parallel to the waist line (510), wherein the waistline (510) is disposed at the top edges of the pelvis sections (230*a*/230*b*), and wherein the ankle line (213) is disposed opposite of the waist line at the bottom ends (244*a*/244*b*) of the legs (240*a*/240*b*);

d) a first pant strip (401) disposed around the waist hole (220) at the waist line (510) of the pant component (210);

e) a second pant strip (402) having a starting point at the first pant strip (401) and extending from the first pant strip (401) down along the first side edges (231*a*/231*b*) of the pelvis sections (230*a*/230*b*) and having an ending point at the bottom end (244*a*) of the first leg (240*a*);

f) a third pant strip (403) having a starting point at the first pant strip (401) and extending from the first pant strip (401) down along the second side edges (232*a*/232*b*) of the pelvis sections (230*a*/230*b*) and having an ending point at the bottom end (244*b*) of second leg (240*b*);

g) a first inseam strip (420) having a starting point at the groin seam (218) at a groin line (511) and extending from the groin seam (218) to the bottom end (244*a*) of the first leg (240*a*) at the ankle line (513) along an inner seam of the first leg (240*a*), the groin line is a straight line where the groin of a wearer of the pant component (210) is located, wherein the groin line (511) is parallel to the waist line (510);

h) a second inseam strip (421) having a starting point at the groin seam (218) at the groin line (511) and extending from the groin seam (218) at the groin line (511) to the bottom end (244*b*) of the second leg (240*b*) at the ankle line (513) along an inner seam of the second leg (240*b*), wherein the groin line (511) is located at an intersection of the inner seam of the first leg (240*a*) and the inner seam of the second leg (240*b*);

i) a fourth pant strip (404) having a starting point at the first pant strip (401) and extending from the first pant strip (401) down to the bottom end (244*a*) of the first leg (240*a*) and positioned in between the first side edges (231*a*/231*b*) of the pelvis sections and the groin seam (218) or inner seam, wherein the starting point of the fourth pant strip (404) is disposed on the front pelvis section (230*a*), wherein the fourth pant strip (404) is disposed in between the second pant strip (402) and the first inseam strip (420);

j) a fifth pant strip (405) having a starting point at the first pant strip (401) and extending from the first pant strip (401) down to the bottom end (244*b*) of the second leg (240*b*) and positioned in between the second side edges (232*a*/232*b*) of the pelvis sections and the groin seam (218) or inner seam, wherein the starting point of the fifth pant strip (405) is disposed on the front pelvis section (230*a*), wherein the fifth pant strip (405) is disposed in between the third pant strip (403) and the second inseam strip (421);

k) a sixth pant strip (406) having a starting point at a first pant point (404*a*) on the fourth pant strip (404) at a knee line (512) and extending from the first pant point (404*a*) upwardly and to the second pant strip (402), the knee line (512) is a straight line from one knee to the other knee of a wearer of the pant component (210), wherein the knee line (512) is parallel to the ankle line (513) and is positioned between the groin line (511) and the ankle line (513) such that the knee line (512) is about midway between the groin line (511) and the ankle line (513);

l) a seventh pant strip (407) having a starting point at the first pant point (404*a*) on the fourth pant strip (404) at the knee line (512) and extending from the first pant point (404*a*) downwardly and to the second pant strip (402);

m) an eighth pant strip (408) having a starting point at the first pant point (404*a*) on the fourth pant strip (404) and extending from the first pant point (404*a*) and wrapping upwardly around the first leg (240*a*) and past an inner seam to a fifth pant point (404*e*) on the second pant strip (402), the fifth pant point (404*e*) being in line with the groin seam (218) on the groin line (511);

n) a ninth pant strip (409) having a starting point at the first pant point (404*a*) on the fourth pant strip (404) and extending from the first pant point (404*a*) and wrapping downwardly and to the first inseam strip (420);

o) a tenth pant strip (410) having a starting point at a third pant point (404*c*) on the fifth pant strip (405) at the knee line (512) and extending from the third pant point (404*c*) upwardly and to the third pant strip (403);

p) an eleventh pant strip (411) having a starting point at the third pant point (404*c*) on the fifth pant strip (405) and extending from the third pant point (404*c*) downwardly and to the third pant strip (403);

q) a twelfth pant strip (412) having a starting point at the third pant point (404*c*) on the fifth pant strip (405) and extending from the third pant point (404*c*) and wrapping upwardly around the second leg (240*b*) and past the inner seam to a sixth pant point (404*f*) on the third pant strip (403), the sixth pant point (404*f*) being in line with the groin seam (218) on the groin line (511);

r) a thirteenth pant strip (413) having a starting point at the third pant point (404*c*) on the fifth pant strip (405) and extending from the third pant point (404*c*) downwardly and to the second inseam strip (421);

s) a fourteenth pant strip (422) having a starting point at a second pant point (404*b*) and extending from the second pant point (404*b*) upwardly and to the first inseam strip (420) of the first leg (240*a*), the second pant point (404*b*) is positioned at a distance below the knee line (512) of the pant component (210);

t) a fifteenth pant strip (423) having a starting point at the second pant point (404*b*) and extending from the second pant point (404*b*) downwardly and to the first inseam strip (420);

u) a sixteenth pant strip (424) having a starting point at the second pant point (404*b*) and extending from the second pant point (404*b*) upwardly and to the second pant strip (402);

v) a seventeenth pant strip (425) having a starting point at the second pant point (404*b*) and extending from the second pant point (404*b*) downwardly and to the second pant strip (402);

w) a eighteenth pant strip (426) having a starting point at a fourth pant point (404*d*) and extending from the fourth pant point (404*d*) upwardly and to the second inseam strip (421) of the second leg (240*b*), the fourth pant point (404*d*) is positioned at a distance below the knee line (512) of the pant component (210);

x) a nineteenth pant strip (427) having a starting point at the fourth pant point (404*d*) and extending from the fourth pant point (404*d*) downwardly and to the second inseam strip (421);

y) a twentieth pant strip (428) having a starting point at the fourth pant point (404*d*) and extending from the fourth pant point (404*d*) upwardly and to the third pant strip (403); and z) a twenty-first pant strip (429) having a starting point at the fourth pant point (404*d*) and extending from the fourth pant point (404*d*) downwardly and to the third pant strip (403);

wherein the strips are constructed from a material comprising elastane.

2. The system (100) of claim 1 further comprising a twenty-second pant strip (414) having a starting point at the second pant strip (402) and extending from the second pant strip (402) and past the fourth pant strip (404) to the first inseam strip (420) on a front portion of the first leg (240*a*) positioned at a distance below the groin line (511), and a twenty-third pant strip (415) having a starting point at the third pant strip (403) and extending from the third pant strip (403) and past the fifth pant strip (405) to the second inseam strip (421) on a front portion of the second leg (240*b*) positioned at a distance below the groin line (511).

3. The system (100) of claim 2 further comprising a twenty-fourth pant strip (416) having a starting point at the second pant point (404*b*) and extending downwardly from the second pant point (404*b*) to the bottom end (244*a*) of the first leg (240*a*) at the ankle line (513), and a twenty-fifth pant strip (417) having a starting point at the fourth pant point (404*d*) and extending downwardly from the fourth pant point (404*d*) to the bottom end (244*b*) of the second leg (240*b*) at the ankle line (513).

4. The system (100) of claim 3 further comprising an twenty-sixth pant strip (418) having a starting point at the first pant strip (401) and extending from the first pant strip (401) downwardly on the back pelvis section (230*b*) and to the eighth pant strip (408) at the groin line (511), and a twenty-seventh pant strip (419) having a starting point at the first pant strip (401) and extending from the first pant strip (401) downwardly on the back pelvis section (230*b*) and to the twelfth pant strip (412) at the groin line (511).

5. A stabilizing garment system (100) for providing support to a muscle or a ligament, said stabilizing garment system (100) comprising a pant component (210) consisting of:

a) a front pelvis section (230*a*) with a first side edge (231*a*) and a second side edge (232*a*) and a back pelvis section (230*b*) with a first side edge (231*b*) and a second side edge (232*b*), the first side edges (231*a*/231*b*) of the pelvis sections (230*a*/230*b*) are connected and the second side edges (232*a*/232*b*) of the pelvis sections (230*a*/230*b*) are connected, and the pelvis sections (230*a*/230*b*) are further connected at a groin seam (218);

b) a waist hole (220) formed by top edges of the pelvis sections (230*a*/230*b*) at a waist line (510) of the pant component (210), the waist line (510) is a straight line where a waist of a wearer of the pant component (210) is located;

c) a first leg (240*a*) extending downwardly from the first side edges (231*a*/231*b*) of the pelvis sections (230*a*/230*b*) to an ankle line (513) of the pant component (210), and a second leg (240*b*) extending downwardly from the second side edges (232*a*/232*b*) of the pelvis sections (230*a*/230*b*) to the ankle line (513) of the pant component (210), the legs (240*a*/240*b*) each have bottom ends (244*a*/244*b*), the legs (240*a*/240*b*) each have an outer seam that aligns with the respective first side edges (231*a*/231*b*) or second side edges (232*a*/232*b*) of the pelvis sections (230*a*/230*b*) and an inner seam that extends from the groin seam (218) to the respective bottom ends (244*a*/244*b*) of the legs (240*a*/240*b*), the ankle line (513) is a straight line that extends from the first bottom end (244*a*) to the second bottom end (244*b*) wherein the ankle line (513) is parallel to the waist line (510), wherein the waistline (510) is disposed at the top edges of the pelvis sections (230*a*/230*b*), and wherein the ankle line (213) is disposed opposite of the waist line at the bottom ends (244*a*/244*b*) of the legs (240*a*/240*b*);

d) a first pant strip (401) disposed around the waist hole (220) at the waist line (510) of the pant component (210);

e) a second pant strip (402) starting at the first pant strip (401) and extending from the first pant strip (401) down along the first side edges (231*a*/231*b*) of the pelvis sections (230*a*/230*b*) and ending at the bottom end (244*a*) of the first leg (240*a*);

f) a third pant strip (403) starting at the first pant strip (401) and extending from the first pant strip (401) down along the second side edges (232*a*/232*b*) of the pelvis sections (230*a*/230*b*) and ending at the bottom end (244*b*) of second leg (240*b*);

g) a first inseam strip (420) starting at the groin seam (218) at a groin line (511) and extending from the groin seam (218) to the bottom end (244*a*) of the first leg (240*a*) at the ankle line (513) along an inner seam of the first leg (240*a*), the groin line is a straight line where the groin of a wearer of the pant component (210) is located, wherein the groin line (511) is parallel to the waist line (510);

h) a second inseam strip (421) starting at the groin seam (218) at the groin line (511) and extending from the groin seam (218) at the groin line (511) to the bottom end (244*b*) of the second leg (240*b*) at the ankle line (513) along an inner seam of the second leg (240*b*), wherein the groin line (511) is located at an intersection of the inner seam of the first leg (240*a*) and the inner seam of the second leg (240*b*);

i) a fourth pant strip (404) starting at the first pant strip (401) and extending from the first pant strip (401) down to the bottom end (244*a*) of the first leg (240*a*) and positioned in between the first side edges (231*a*/231*b*) of the pelvis sections and the groin seam (218) or inner seam, wherein fourth pant strip (404) starts at the first pant strip (401) at the front pelvis section (230*a*), wherein the fourth pant strip (404) is disposed in between the second pant strip (402) and the first inseam strip (420);

j) a fifth pant strip (405) having a starting point at the first pant strip (401) and extending from the first pant strip (401) down to the bottom end (244*b*) of the second leg (240*b*) and positioned in between the second side edges (232*a*/232*b*) of the pelvis sections and the groin seam (218) or inner seam, wherein the fifth pant strip (405) starts at the first pant strip (401) at the front pelvis section (230*a*), wherein the fifth pant strip (405) is disposed in between the third pant strip (403) and the second inseam strip (421);

k) a sixth pant strip (406) starting at a first pant point (404*a*) on the fourth pant strip (404) at a knee line (512) and extending from the first pant point (404*a*) upwardly and to the second pant strip (402), the knee line (512) is a straight line from one knee to the other knee of a wearer of the pant component (210), wherein the knee line (512) is parallel to the ankle line (513) and is positioned between the groin line (511) and the ankle line (513) such that the knee line (512) is about midway between the groin line (511) and the ankle line (513);

l) a seventh pant strip (407) starting at the first pant point (404*a*) on the fourth pant strip (404) at the knee line (512) and extending from the first pant point (404*a*) downwardly and to the second pant strip (402);

m) an eighth pant strip (408) starting at the first pant point (404*a*) on the fourth pant strip (404) and extending from the first pant point (404*a*) and wrapping upwardly around the first leg (240*a*) and past an inner seam to a fifth pant point (404*e*) on the second pant strip (402), the fifth pant point (404*e*) being in line with the groin seam (218) on the groin line (511);

n) a ninth pant strip (409) starting at the first pant point (404*a*) on the fourth pant strip (404) and extending from the first pant point (404*a*) and wrapping downwardly and to the first inseam strip (420);

o) a tenth pant strip (410) starting at a third pant point (404*c*) on the fifth pant strip (405) at the knee line (512) and extending from the third pant point (404*c*) upwardly and to the third pant strip (403);

p) an eleventh pant strip (411) starting at the third pant point (404*c*) on the fifth pant strip (405) and extending from the third pant point (404*c*) downwardly and to the third pant strip (403);

q) a twelfth pant strip (412) starting at the third pant point (404*c*) on the fifth pant strip (405) and extending from the third pant point (404*c*) and wrapping upwardly around the second leg (240*b*) and past the inner seam to a sixth pant point (404*f*) on the third pant strip (403), the sixth pant point (404*f*) being in line with the groin seam (218) on the groin line (511);

r) a thirteenth pant strip (413) starting at the third pant point (404*c*) on the fifth pant strip (405) and extending from the third pant point (404*c*) downwardly and to the second inseam strip (421);

s) a fourteenth pant strip (422) starting at a second pant point (404*b*) and extending from the second pant point (404*b*) upwardly and to the first inseam strip (420) of the first leg (240*a*), the second pant point (404*b*) is positioned at a distance below the knee line (512) of the pant component (210);

t) a fifteenth pant strip (423) starting at the second pant point (404*b*) and extending from the second pant point (404*b*) downwardly and to the first inseam strip (420);

u) a sixteenth pant strip (424) starting at the second pant point (404*b*) and extending from the second pant point (404*b*) upwardly and to the second pant strip (402);

v) a seventeenth pant strip (425) starting at the second pant point (404*b*) and extending from the second pant point (404*b*) downwardly and to the second pant strip (402);

w) a eighteenth pant strip (426) starting at a fourth pant point (404*d*) and extending from the fourth pant point (404*d*) upwardly and to the second inseam strip (421) of the second leg (240*b*), the fourth pant point (404*d*) is positioned at a distance below the knee line (512) of the pant component (210);

x) a nineteenth pant strip (427) starting at the fourth pant point (404*d*) and extending from the fourth pant point (404*d*) downwardly and to the second inseam strip (421);

y) a twentieth pant strip (428) starting the fourth pant point (404*d*) and extending from the fourth pant point (404*d*) upwardly and to the third pant strip (403); and z) a twenty-first pant strip (429) starting at the fourth pant point (404*d*) and extending from the fourth pant point (404*d*) downwardly and to the third pant strip (403);

wherein the strips are constructed from a material comprising elastane.

* * * * *